US006250495B1

(12) United States Patent
Bando

(10) Patent No.: US 6,250,495 B1
(45) Date of Patent: Jun. 26, 2001

(54) PRODUCT HOUSING STACKED BODY OF WET TISSUES

(75) Inventor: Takeshi Bando, Kagawa (JP)

(73) Assignee: Uni-Charm Corporation, Kawanoe (JP)

( * ) Notice: Subject to any disclaimer, the term of this patent is extended or adjusted under 35 U.S.C. 154(b) by 0 days.

(21) Appl. No.: 09/368,612

(22) Filed: Aug. 4, 1999

(30) Foreign Application Priority Data

Aug. 11, 1998 (JP) ..... 10-226778

(51) Int. Cl.[7] ..... A47K 10/24
(52) U.S. Cl. ..... 221/48; 206/812
(58) Field of Search ..... 221/48, 45, 33, 221/47, 50; 206/494, 812, 554

(56) References Cited

U.S. PATENT DOCUMENTS

| | | | | |
|---|---|---|---|---|
| 3,207,360 | * | 9/1965 | Scott | 221/48 |
| 3,401,927 | | 9/1968 | Frick et al. | 270/40 |
| 5,497,903 | | 3/1996 | Yoneyama | 221/48 |
| 6,045,002 | * | 7/1998 | Wierschke | 221/48 |

FOREIGN PATENT DOCUMENTS

0970909 A2 1/2000 (EP) .

09234167 9/1997 (JP) .

* cited by examiner

*Primary Examiner*—Kenneth W. Noland
(74) *Attorney, Agent, or Firm*—Darby & Darby

(57) ABSTRACT

A wet tissue product composed of a stacked body of folded wet tissues and a container or package housing the stacked body is disclosed. The folded wet tissues fall into two groups; a first-group of folded wet tissues and a second-group of folded wet tissues. Each of the first-group of folded wet tissues is formed by folding a plane wet tissue in two generally along a centerline thereof to have an upper half and a lower half, and each of the second-group of folded wet tissues is formed by folding a plane wet tissue with one edge thereof upward and the other edge thereof downward, to have an upper folded portion, a lower folded portion and an intermediate portion. The first-group of folded wet tissues and second-group of folded wet tissues are alternately stacked in such a manner that the upper half of the first-group of folded wet tissue is sandwiched between the lower folded portion and the intermediate portion of the overlying second-group of folded wet tissue, and the lower half of the first-group of folded wet tissue is sandwiched between the upper folded portion and the intermediate portion of the underlying second-group of folded wet tissue, thereby to form the stacked body.

7 Claims, 8 Drawing Sheets

PRODUCT HOUSING STACKED BODY OF WET TISSUES

FIELD OF THE INVENTION

The present invention relates to a wet tissue product having a stacked body of folded wet tissues housed in a container or package.

BACKGROUND OF THE INVENTION

In general, wet tissues are scaled and housed in a container or package so as to keep their wet state before use or when unused. These wet tissues are folded and sequentially stacked to have combined areas so that they are sequentially pulled out one by one from an outlet provided in the container or package. When the wet tissue at the uppermost position is pulled out, a portion of the succeeding wet tissue protrudes from the outlet of the container. This is generally called the "pop-up type".

As a method to form such a pop-up type wet tissue stacked body, for example, it is well known in the art to double each wet tissue into a "V" shape to form upper and lower halves, and to stack them such that the upper half of each wet tissue is sandwiched between the upper and lower halves of the overlying wet tissue, and the remaining lower half is sandwiched between the upper and lower halves of the underlying wet tissue, as shown in FIG. 6. With this wet tissue stacked body, however, when the upper wet tissue is pulled out, the upper half of the succeeding wet tissue is protruded from the outlet so that its protrusion becomes so large as one half of the area of the unfolded wet tissue. If the protrusion of the wet tissue from the outlet is excessively large, it is not confined within the area of a cover which is usually provided with the container or package to close (or cover around) the outlet, so that the protrusion partially extends from the cover and dries up. Further, if the wet tissue thus partially extends from the cover, this cover is not reliably closed to lower the sealability of the container or package so that the wet tissues inside of the container or package are susceptible to drying out.

FIG. 7 shows another method to form a pop-up type wet tissue stacked body. In this method, each wet tissue is folded in three into a "Z" shape to form an upper folded portion, a lower folded portion and an intermediate folded portion between them (or with one edge upward and with the other edge downward). The three-folded wet tissues are stacked such that the upper folded portion of each wet tissue is sandwiched between the intermediate portion and the lower portion of the overlying wet tissue and the lower folded portion thereof is sandwiched between the upper folded portion and the intermediate portion of the underlying wet tissue. In this wet tissue stacked body, the protrusion from the outlet can be made smaller than that shown in FIG. 6, to one third of the area of the unfolded wet tissue. However, since each wet tissue is folded into three, the stacked body has a thickness of 1.5 times as large as that of the stacked body which is formed of an equal number of wet tissues and in which each wet tissue is folded into two (or into the V-shape).

In Unexamined Published Japanese Patent Application No. 7-213453 (corresponding to U.S. Pat. No. 5,497,903), on the other hand, there is disclosed a folding structure for wet tissues to be consecutively pulled out one by one. In this folding structure, as shown in FIG. 8, each wet tissue is folded in two, in the same manner as shown in FIG. 6, and thereafter a lower half of each wet tissue is further folded downward in two, so as to have an upper half, a small intermediate portion and a small lower portion. That is, each wet tissue is folded into a deformed Z-shape. Then, the wet tissues are stacked so that the upper half of each wet tissue is sandwiched between the upper half and the small intermediate portion of the overlying wet tissue. According to this construction, the protrusion of the wet tissue from the outlet is proper (at about one quarter of the area of the unfolded wet tissue). Further, the stacked body is not as high as compared with that shown in FIG. 6.

In this wet tissue folding structure, however, the upper half of the wet tissue positioned third from the top is making contact, over a wide area, with both the wet tissue positioned at the top and the wet tissue positioned second from the top. When the wet tissue positioned at the top is pulled out, therefore, the wet tissue positioned third from the top may also protrude from the outlet. Alternatively, there may be such a case that the smaller lower portion is dragged on the upper half of the wet tissue positioned third from the top, thereby unfolding the lower half and making the uppermost wet tissue into the V-shape. In this case, the upper half of the succeeding wet tissue is so wholly protruded from the outlet that its protrusion becomes as large as one half of the area of the unfolded wet tissue.

Thus in the construction shown in FIG. 8, the individual wet tissues are combined in a very complicated manner making it difficult to pull them out one by one via the necessary protrusion. To overcome this difficulty, conventional methods of separating the wet tissues either make the outlet of the container housing them extremely narrow or establish a resistance by a resisting portion provided at the outlet. In this case, however, a considerable amount of hard work is required to pull out the wet tissues one by one. Moreover, when a wet tissue is pulled out, the container is also raised together with the wet tissue and must be held with the hands thereby making the pull-out very inconvenient.

SUMMARY OF THE INVENTION

The invention has been conceived to solve the problems of the prior art thus far described, and has an object to provide a wet tissue product whereby when a wet tissue is pulled out, the protrusion of the succeeding wet tissue is small.

Another object of the invention is to provide a wet tissue product from which a wet tissue can be pulled out always with a constant protrusion.

The invention provides a wet tissue product comprising a stacked body of folded wet tissues and a container or package housing said stacked body, wherein the folded wet tissues fall into two groups; a first-group of folded wet tissues and a second-group of folded wet tissues, each of the first-group of folded wet tissues is formed by folding a plane wet tissue in two generally along a centerline thereof, to have an upper half and a lower half, each of the second-group of folded wet tissues is formed by folding a plane wet tissue with one edge thereof upward and with the other edge thereof downward, to have an upper folded portion, a lower folded portion and an intermediate portion, and the first-group of folded wet tissues and second-group of folded wet tissues are alternately stacked in such a manner that the upper half of the first-group of folded wet tissue is sandwiched between the lower folded portion and the intermediate portion of the overlying second-group of folded wet tissue, and the lower half of the first-group of folded wet tissue is sandwiched between the upper folded portion and the intermediate portion of the underlying second-group of folded wet tissue, thereby to form the stacked body.

In the invention, it is preferable that an area of the upper folded portion is equal to that of the lower folded portion.

In the invention, further, it is preferable that the area of the respective upper and lower folded portions is about one quarter of that of the plane wet tissue before folding.

In the invention, furthermore, it is preferable that the plane wet tissue to form the first-group of folded wet tissue and the plane wet tissue to form the second-group of folded wet tissue are identical to each other in shape and size.

In the invention, moreover, it is preferable that the wet tissue exhibits a lower adhesion at one face and a higher adhesion at the other face to another wet tissue in a face-to-face contacting relationship, and the first-group of folded wet tissues and second-group of folded wet tissues are combined such that the face of a lower adhesion and the other face of a higher adhesion confront each other at a combined area where the half of the first-group of folded wet tissue and the folded portion of the second-group of folded wet tissue overlap with each other.

For the convenience of picking up a wet tissue, in the invention, it is preferable that the container or package has an outlet which is positioned to confront the central portion of the faces of the folded wet tissues. In such case, one of the second-group of folded wet tissues is preferably arranged at the uppermost position of the stacked body. More preferably, one of the second-group of folded wet tissues is arranged at the lowermost position of the stacked body as well.

DETAILED DESCRIPTION OF THE INVENTION

The invention is described with reference to the accompanying drawings.

Figure 1A:
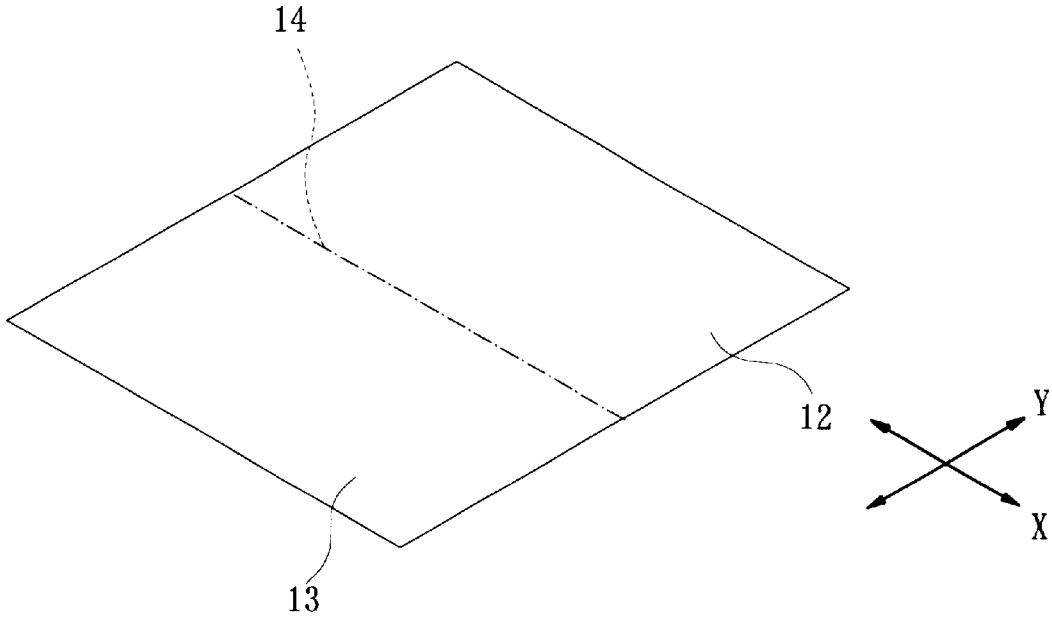
FIGS. 1(A) and 1(B) are perspective views showing a method of folding a wet tissue of a first group of a wet tissue product of the invention.
Figure 1B:
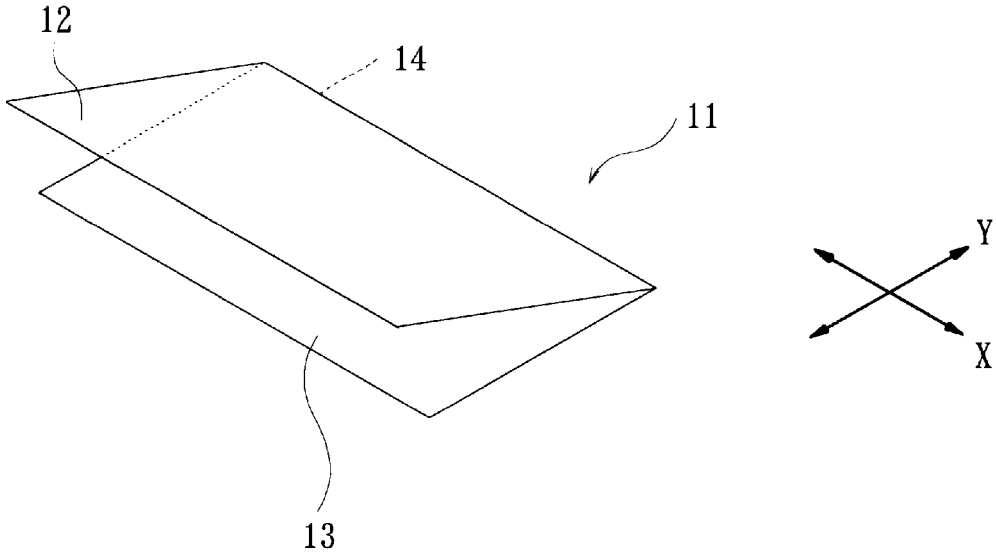
Figure 2A:
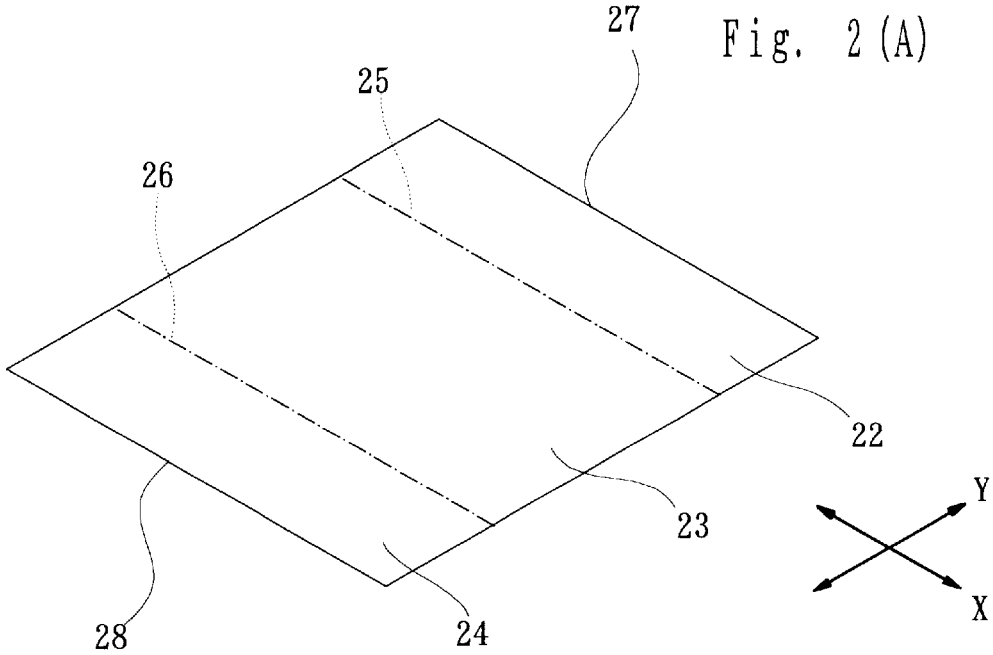
FIGS. 2(A) and 2(B) are perspective views showing a method of folding a wet tissue of a second group of the wet tissue product of the invention.
Figure 2B:
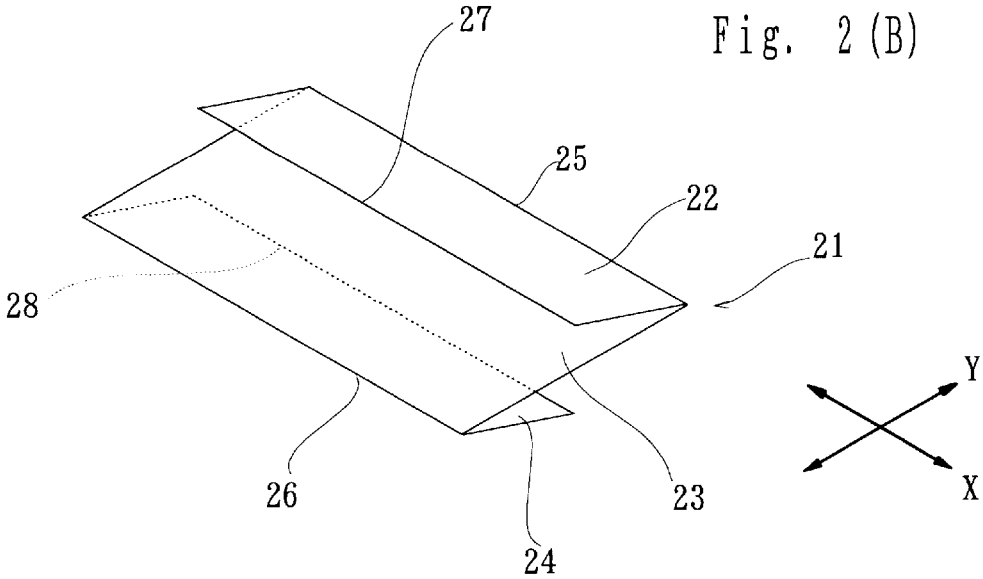
Figure 3:
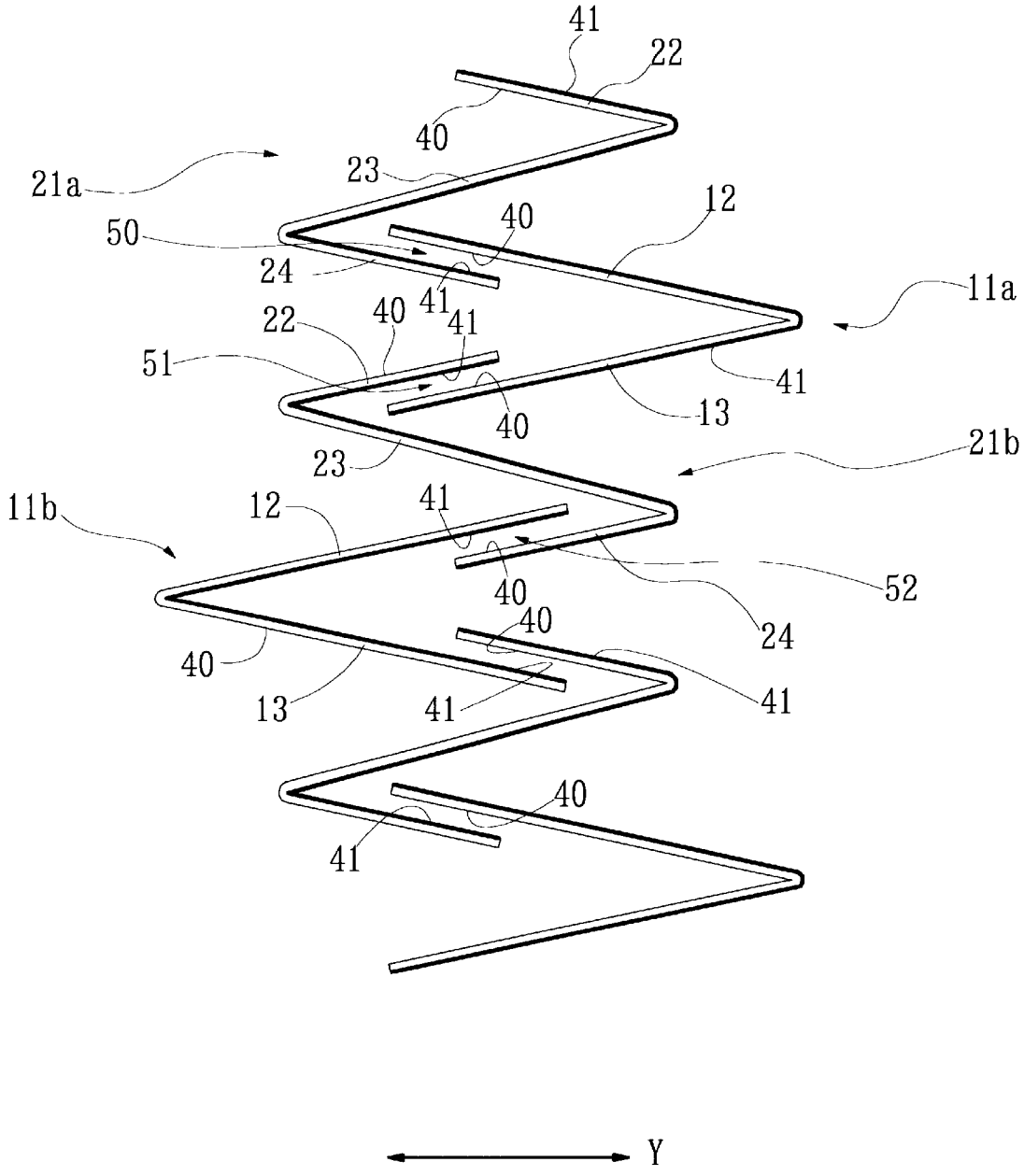
FIG. 3 is a section depicting a method of combining the wet tissues of the first group and the second group.
Figure 4:
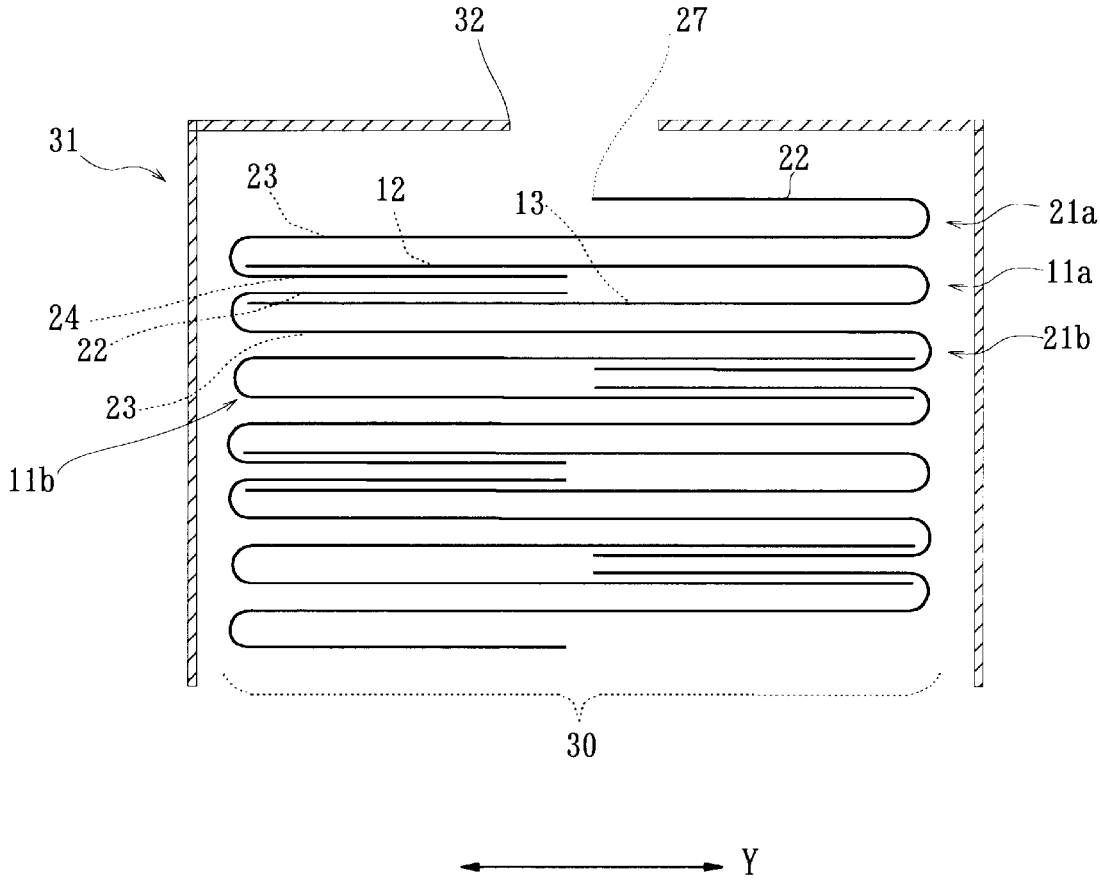
FIG. 4 is a section of the wet tissue product of the invention.

FIGS. 1(A) and 1(B) are perspective views showing a method of folding a wet tissue to form a first-group of folded wet tissue; FIGS. 2(A) and 2(B) are perspective views showing a method of folding a wet tissue to form a second-group of folded wet tissue; FIG. 3 is a section for explaining a method of combining the folded wet tissues of the first group and the second group; and FIG. 4 is a section showing the wet tissue product of the invention.

Folded wet tissues of the invention fall into two groups; a first group of folded wet tissues and a second group of folded wet tissues. Hereinafter, the first group of folded wet tissues are indicated by 11 (including 11*a* and 11*b*) and the second-group of folded wet tissues are indicated by 21 (including 21*a* and 21*b*).

The first-group of folded wet tissue 11 is formed by folding a plane wet tissue in two. As shown in FIG. 1(A), the plane wet tissue has a rectangular shape (a lateral dimension in the direction X and a longitudinal dimension in the direction Y). This plane wet tissue is folded in two along a generally central folding line (or laterally extending centerline) 14 into a shape generally of letter "V", as shown in FIG. 1(B). In the first-group of folded wet tissue 11 shown in FIG. 1(B), an upper half 12 and a lower half 13 have substantially equal areas and are symmetric with respect to the folding line 14.

On the other hand, the second-group of folded wet tissue 21 is formed by folding a plane wet tissue into three portions. As shown in FIG. 2(A), the plane wet tissue for the second-group of folded wet tissue 21 has the same rectangular shape and size (a lateral dimension in the direction X and a longitudinal dimension in the direction Y) as that shown in FIG. 1(A). This plane wet tissue is folded along folding lines 25 and 26, with its laterally extending edges 27 and 28 in the opposite directions (i.e., upward and downward, respectively). The second-group of folded wet tissue 21 thus obtained has a shape generally of the letter "Z", as shown in FIG. 2(B). The second-group of folded wet tissue 21 has an upper folded portion 22 and a lower folded portion 24 while leaving an intermediate portion 23 between them. The folding lines 25 and 26 extend in the direction X (i.e., the lateral direction of the unfolded wet tissue), and the folding line 25 is spaced from the edge 27 by about one quarter of the longitudinal dimension of the plane wet tissue (i.e., unfolded wet tissue) whereas the folding line 26 is spaced from the edge 28 by about one quarter of the longitudinal dimension of the plane wet tissue (i.e., unfolded wet tissue).

The first-group of folded wet tissues 11 and the second-group of folded wet tissues 21 thus obtained are alternately stacked one by one, as shown in FIG. 3. The intermediate portion 23 and the lower folded portion 24 of the second-group of wet tissue 21*a* is sandwiched between the upper half 12 of the first-group of wet tissue 11*a* which is located below the second-group of wet tissue 21*a*. The upper half 12 and the lower half 13 of the first-group of wet tissue 11*a*, moreover, is sandwiched between the upper folded portion 22 of the second-group of wet tissue 21*b* which is located below first-group of wet tissue 11*a*. That is, the lower half 13 of the first group of wet tissue 11*a* is sandwiched between the upper folded portion 22 and the intermediate portion 23 of the second-group of wet tissue 21*b*.

The first-group of folded wet tissues 11 and the second-group of folded wet tissues 21 are sequentially combined in the aforementioned manners to provide a stacked body 30 of wet tissues, as shown in FIG. 4. This wet tissue stacked body 30 is constructed by combining a number of wet tissues, e.g., fifty or one hundred.

In FIG. 4, the wet tissue stacked body 30 is housed in a container 31 having an outlet 32 for pulling out the wet tissues, to provide a wet tissue product of the invention. Here, the container 31 is scaled up excepting the outlet 32 so that its wet tissues may be prevented from drying up, although its bottom is omitted in FIG. 4. Further, the container 31 is generally provided with a cover (or lid) for closing (or covering) the outlet 32, although it is omitted in FIG. 4.

Upon use, the uppermost second-group of wet tissue 21*a* is pinched at its edge 27 through the outlet 32 and is pulled out of the outlet 32. At this time, about a half of the upper half 12 of the underlying first-group of wet tissue 11*a* is adhered to and lifted up with the lower folded portion 24 of the wet tissue 21*a*, and then comes out of the outlet 32. In other words, the wet tissue 11*a* is lifted up together with the wet tissue 21*a*, until a combined area 50 comes out of the outlet 32. This term "combined area" as used herein means an area where the lower wet tissue is located over the upper wet tissue, i.e., an area where the upper or lower half of the first-group of folded wet tissue 11 and the upper or lower folded portion of the second-group of folded wet tissue 21 overlap with each other. Then, the wet tissue 21*a* is separated from the wet tissue 11*a* by the resistance which is established as the wet tissue 11*a* comes into contact with the outlet 32.

Next, the first-group of wet tissue 11*a*, as partially protruded from the outlet 32, is pulled out of the outlet 32. At this time, the upper folded portion 22 of the underlying second-group of wet tissue 21*b* is adhered to and lifted up with about a half of the lower half 13 of the wet tissue 11*a*, and then comes out of the outlet 32. In other words, the wet tissue 21*b* is lifted up together with the wet tissue 11*a*, until a combined area 51 comes out of the outlet 32. Then, the wet tissue 11*a* is separated from the wet tissue 21*b* by the resistance which is established as the wet tissue 21*b* comes into contact with the outlet 32.

Moreover, the second-group of wet tissue 21*b*, as partially protruded from the outlet 32, is pulled out of the outlet 32. As in the case of the second-group of wet tissue 21*a* is pulled out, about a half of the upper half 12 of the underlying first-group of wet tissue 11*b* is adhered to and lifted up with the lower folded portion 24 of the wet tissue 21*b*, and then comes out of the outlet 32. In other words, the wet tissue 11*b* is lifted up together with the wet tissue 21*b*, until a combined area 52 comes out of the outlet 32. Then, the wet tissue 21*b* is separated from the wet tissue 11*b* by the resistance which is established as the wet tissue 11*b* comes into contact with the outlet 32.

As in the aforementioned manners, when one wet tissue is pulled out from the outlet 32, the underlying wet tissue is partially lifted together to come out of and remain over the outlet 32 so that the wet tissues can be pulled out one by one without difficulty.

It will be understood from the discussion thus made that the protrusion of the wet tissue from the outlet 32 is substantially equal to the size of the combined area between the upper and lower wet tissues. In the stacked body of the invention, as shown in FIGS. 3 and 4, the size of the combined area is substantially equal to or smaller than the folded portion 22 or 24. In other words, the protrusion of the wet tissue from the outlet 32 is one quarter or less than the area of the plane wet tissue (unfolded wet tissue).

Figure 5:
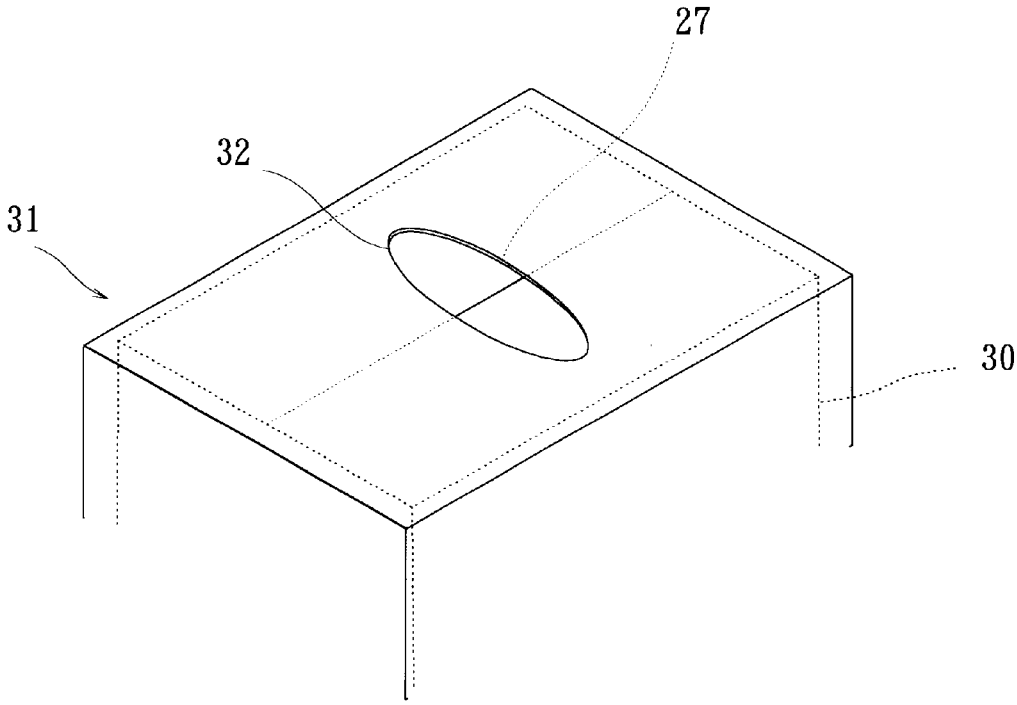
FIG. 5 is a partial perspective view of the wet tissue product of the invention.

Here, the face-to-face contact between wet tissues may have increased adhesion due to the surface tension of the water which is contained therein. If the face-to-face contact between the wet tissues becomes excessively high, then when an upper wet tissue is pulled out, a succeeding wet tissue may be dragged with its protrusion more than necessary (e.g., more than one quarter the area of the unfolded wet tissue). This may produce the unwanted result that several wet tissues are pulled out altogether. In this case, therefore, it is preferable to reduce the open area of the outlet 32 sufficiently, as shown in FIG. 5, or to give the outlet 32 a corrugated shape or provide it with a resistive portion, thereby to give a proper resistance to the wet tissue.

In this case, when the upper wet tissue is pulled out from the outlet 32, the adhesion at the combined area (as indicated by 50, 51 or 52) between the upper and lower wet tissues overcomes the resistance of the outlet 32. When the combined area comes out of the outlet 32, then, the remaining portion, which underlies the combined area, of the lower wet tissue receives resistance from the outlet 32 so that the upper and lower wet tissues are separated from each other by the peeling force in the shearing direction when the combined area completely leaves the outlet 32. In other words, the lower wet tissue is left inside the container 31 except for the portion put on the upper wet tissue.

According to the invention, however, it is relatively easy to take out the wet tissues reliably one by one and to make the wet tissues protrude by an appropriate amount. Therefore, it is not necessary to establish a resistance so high as that of the wet tissue container of the prior art. In the container 31 of the invention, for example, the open area of the outlet 32 can be enlarged (such that the major axis of the outlet 32 is slightly smaller than the width of the folded wet tissues). Alternatively, the resisting portion which could otherwise exhibit the resistance at the outlet 32 may not be formed. This is explained in detail below.

Generally, the face-to-face contacting wet tissues require a high force for separating them in the shearing direction, but can easily be separated when they are gradually peeled in the vertical direction from each other at their edges.

In the wet tissue stacked body of the invention, the uppermost second-group of wet tissue 21*a* is in face-to-face contact at its lower folded portion 24 with the upper folded portion 22 of the second-group of wet tissue 21*b* positioned third from the top. When the uppermost second-group of wet tissue 21*a* is pulled out, however, the folding portion 24 of the wet tissue 21*a* and the folding portion 22 of the wet tissue 21*b* are vertically peeled from their individual folding lines (or edges of the folded wet tissues) so that they are easily separated from each other. As in the aforementioned manner, in the invention, it is prevented that the second-group of wet tissue positioned third from the top is erroneously pulled out of the outlet together with the uppermost second-group of wet tissue.

On the other hand, when the first-group of wet tissue 11*a* appears on the top, this uppermost first-group of wet tissue 11*a* is in face-to-face contact only with the succeeding second-group of wet tissue 21*b*. That is, the uppermost first-group of wet tissue 11*a* is out of contact with the first-group of wet tissue 11*b* positioned third from the top. As in the aforementioned manner, in the invention, the first-group of wet tissue positioned third is not erroneously pulled out of the outlet together with the uppermost first-group of wet tissue.

Incidentally, between the upper wet tissue and the lower wet tissue, the force pulling out the upper wet tissue can act in a shearing direction at the combined area. Therefore, the lower wet tissue is not separated from the upper wet tissue until the combined area comes out of the outlet. As a result, the lower wet tissue never fails to protrude from the outlet.

In order to prevent the lower wet tissue from protruding from the outlet 32 by a distance greater than necessary, on the other hand, it is preferable to make the adhesion (or the engaging force) between the wet tissues as weak as possible. In order to make the degree of the protrusions of the wet tissues from the outlet 32 uniform, further, it is also preferable to homogenize the adhesion of the wet tissues at the aforementioned combined areas.

The adhesion (or the engaging force), which is established when the wet tissues contact in a face-to-face relation with each other through a liquid, is influenced by the differences in the roughness of the tissue surfaces and in the hydrophilic nature and water retention of fibers appearing on the tissue surfaces. Where the wet tissue is made of a spun lace nonwoven fabric, for example, it has a relatively smooth and good-sliding face (of a low adhesion (or engaging force)) on the side, which is directly treated by the water jets (or water flow for interlacing the fibers) at the step of making the spun lace nonwoven fabric, and a relatively rough and less-sliding face (of a high adhesion (or engaging force)) on the other side, which is not treated by the water jets and becomes fluffy. This result likewise applies to the wet tissue which is manufactured by the wet paper making process, and the side that confronts a cylinder mold in the paper making process becomes a relatively rough and less-sliding face (of a high adhesion (or engaging force)).

Further, there may be a wet tissue made of a nonwoven fabric having a two layered structure composed of a layer containing more hydrophobic fibers and a layer containing more hydrophilic fibers. In this wet tissue, the layer containing the hydrophobic fibers cannot easily retain water so that the adhesion by the surface tension of the liquid is lowered thereby providing a face having a relatively low adhesion (or engaging force). On the other hand, the other layer containing the hydrophilic fibers more readily retains the water so that the adhesion by the surface tension of the liquid is enhanced thereby providing a face having a relatively high adhesion (or engaging force).

In the wet tissue stacked body, as shown in FIG. 3, the upper and lower wet tissues are combined such that the face having a higher adhesion (i.e., more adhesive face) and the face having a lower adhesion (i.e., less adhesive face) are confronted by each other at the combined area (as indicated by 50, 51 or 52). Therefore, the adhesion between the upper and lower wet tissues is not excessive but appropriate, and is homogeneous at all the combined areas.

Of each wet tissue in FIG. 3, the face having a lower adhesion is designated by 40, and the face having a higher adhesion is designated by 41. The second-group of wet tissue 21*a* positioned at the top and the first-group of wet tissue 11*a* positioned second from the top contact each other at the lower folded portion 24 of wet tissue 21*a* and the upper half 12 of wet tissue 11*a*, via the more adhesive face 41 and the less adhesive face 40, which confront each other at the combined area 50.

Next, the first-group of wet tissue 11*a* positioned second from the top and the second-group of wet tissue 21*b* positioned third from the top contact each other at the lower half 13 of the wet tissue 11*a* and the upper folded portion 22 of the wet tissue 21*b*, via the less adhesive face 40 and the more adhesive face 41, which confront each other at the combined area 51. For this combination, as seen in FIG. 3, the second-group of wet tissue 21*a* positioned at the top and the second-group of wet tissue 21*b* positioned third from the top are folded in a Z-shape with their front and back faces being the reverse of each other.

Moreover, the second-group of wet tissue 21*b* positioned third from the top and the first-group of wet tissue 11*b* positioned fourth from the top contact each other at the lower folded portion 24 of the wet tissue 21*b* and the upper half 12 of the wet tissue 11*b*, via the more adhesive face 41 and the less adhesive face 40, which confront each other at the combined area 52. For this combination, as seen in FIG. 3, the first-group of wet tissue 11*b* positioned fourth from the top and the first-group of wet tissue 11*a* positioned second from the top are folded in a V-shape with their front and back faces being the reverse of each other.

In this wet tissue stacked body 30, therefore, the first-group of wet tissues 11 having the more adhesive face 41 on the V-shaped valley side (or inner side) and the first-group of wet tissues 11 having the less adhesive face 40 on the V-shaped valley side are alternately arranged with the second-group of wet tissues 21 interposed therebetween. On the other hand, the second-group of wet tissues 21 having the more adhesive face 41 facing upward at the upper folded portion 22 and the second-group of wet tissues 21 having the less adhesive face 40 facing upward at the upper folded portion 22 are alternately arranged with the first-group of wet tissue 11 interposed therebetween.

With such construction, because the more adhesive faces 41 and the less adhesive faces 40 confront each other at the combined areas 50, 51 and 52, as described above, the adhesions are not excessive and prevent numerous wet tissues from being pulled out together. Further, the protrusion from the outlet is stabilized among the individual wet tissues. When an upper wet tissue is pulled out of the outlet 32, it is relatively easily separated from the lower wet tissues.

Since the combined areas are thus constructed, the resistance applied at the outlet 32 to the wet tissues can be lowered. As a result, the user can pull out the wet tissues one by one, exerting relatively little force, so that the wet tissue product provides an excellent feeling of use. When the wet tissue is pulled out of the outlet 32, the container 31 is rarely pulled up together with the wet tissue.

However, if the wet tissue is made of a nonwoven fabric having no difference in adhesion (or engaging force) between the front and back sides, it is unnecessary to consider the aforementioned combination. For example, the wet tissue may be made of a nonwoven fabric having a three-layered structure, which is composed of two outer layers containing relatively more hydrophobic fibers and an intermediate layer containing relatively more hydrophilic fibers. If such a nonwoven fabric is employed, there will be no difference in adhesion (or engaging force) between the front and back sides of the wet tissue, so that the adhesion between the upper and lower wet tissues is always constant at the combined areas (as indicated by 50, 51 and 52). If such a nonwoven fabric is employed, moreover, the water present between the wet tissues is reduced due to the hydrophobic fibers so that the adhesion (or engaging force) between the wet tissues due to the surface tension of the water becomes relatively weak. As a result, the wet tissues can be pulled out smoothly.

The wet tissue may be made of a nonwoven fabric in which both the front and back faces are made uneven (or have recesses). This unevenness of the wet tissue faces makes it possible for the air to enter between the confronting faces of the upper and lower wet tissues, so that the surface tension of water is lowered thereby to lower the adhesion between the wet tissues.

As has been described above, in the wet tissue product of the invention, when the uppermost wet tissue is pulled out, the degree of protrusion of the succeeding wet tissue from the outlet 32 is as small as about one quarter of the area of the unfolded wet tissue. As a result, the wet tissue is less dried compared with the prior art. Also, the protruded portion is excellent in appearance. In the case where a cover is provided to the container 31 for covering around the outlet 32, the protruded portion of the wet tissue from the outlet 32 can be easily confined within the area of the cover when it is closed to cover the outlet 32, so that sealing the container 31 is easily carried out.

Furthermore, since the first-group of wet tissue 11 is formed by folding a plane wet tissue in two, the folding process is easy to carry out, and the upper half 12 and the lower half 13 hardly have a dispersion in their folded areas at the time of mass production.

Figure 6:
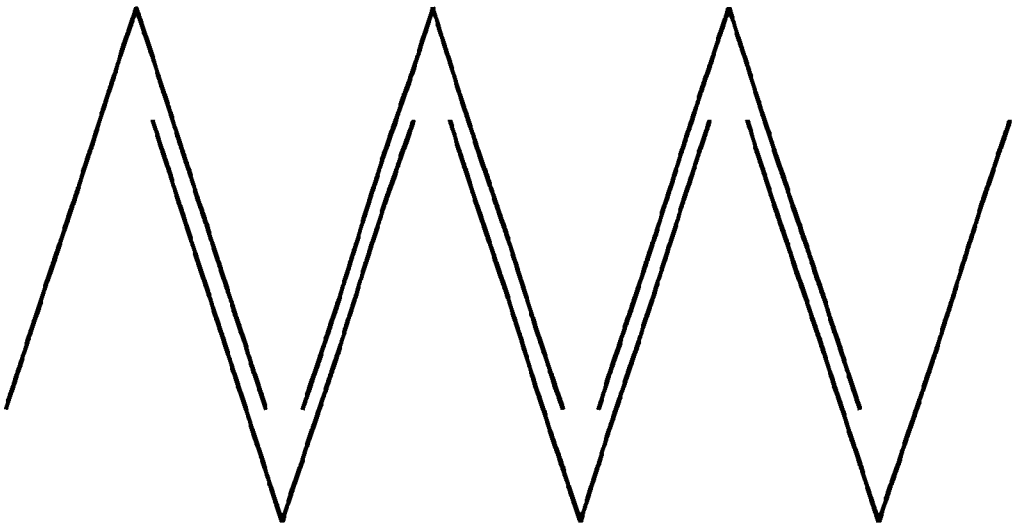
Fig. 6 PRIOR ART
FIG. 6 is a section showing a stacked body of wet tissues of the prior art.
Figure 7:
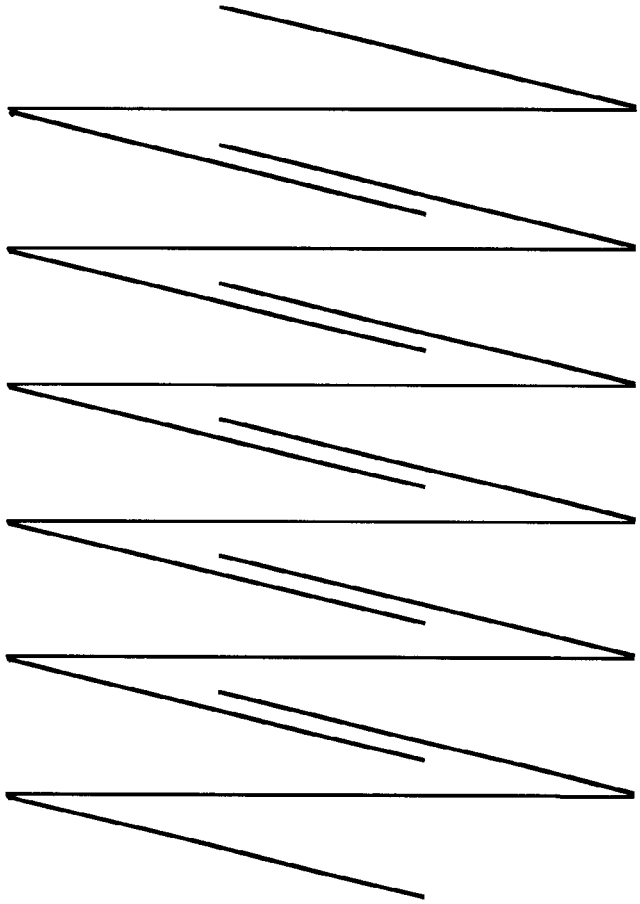
Fig. 7 PRIOR ART
FIG. 7 is a section showing another stacked body of wet tissues of the prior art.

Moreover, since the areas of the upper folded portion 22 and the lower folded portion 24 are about one quarter of the area of the plane wet tissue (unfolded wet tissue), respectively, as shown in FIG. 2(A), the second-group of folded wet tissue 21 shown in FIG. 2(B) has a thickness equal to that of two plane wet tissues. This thickness is equal to that of the first-group folded wet tissue 11, as shown in FIG. 1(B). Therefore, the overall height of the wet tissue stacked body 30 does not become much higher than that of the prior art, in which all the wet tissues are doubled and stacked, as shown in FIG. 6.

FIG. 5 is a perspective view partially showing the exterior of the unused wet tissue stacked body 30 which is housed in the container 31 of FIG. 4. The outlet 32 is disposed generally in the central portion of the upper face of the container 31. More specifically, the outlet 32 is located at a position to confront the central portion of the faces of the folded wet tissues which compose the wet tissue stacked body 30 housed in the container 31. In FIG. 5, the second-group of folded wet tissue 21 exists at the uppermost position of the stacked body 30 so that the edge 27 appears at the center of the outlet 32. When the wet tissue product is used for the first time, therefore, the wet tissue 21 can be easily pulled out by pinching the edge 27. Therefore, in a wet tissue product of the invention before use (or at the production process of the wet tissue product), it is preferred that the wet tissues are combined such that the second-group of folded wet tissue 21 confronts the outlet 32.

Further, as shown in FIG. 3, in the wet tissue stacked body 30 of the invention, the wet tissues are stacked in the same manner even when it is seen from the bottom side thereof (i.e., even when it is observed in an upside down state). Although the outlet is located above in FIG. 4, therefore, the wet tissues could be sequentially pulled out one by one even if the outlet were formed below. Further, at the production process of the wet tissue product of the invention, the wet tissue stacked body can be housed in a container or package regardless of its top and bottom in the stacking direction. In this case, it is preferred that the second-group of folded wet tissue 21 is arranged at the lowermost position of the stacked body 30 as well as at the uppermost position thereof, as shown in FIG. 4, so as to facilitate the first pull-out of the wet tissue no matter which of the top or bottom of the stacked body 30 might confront the outlet.

The wet tissues 11 and 21 are made of a nonwoven fabric or paper composed of natural fibers and/or synthetic fibers. For example, use can be made of a spun lace nonwoven fabric made of polyethylene or polypropylene and having a high wet strength. The wet tissues 11 and 21 can be impregnated with water, alcohol, humectants, surface active agents, perfumes, antiseptics, mildewcides, or the like.

The container 31 is made relatively hard using a synthetic resin such as polyethylene, polypropylene, or the like. The container 31 is preferably provided with a cover for closing (covering around) the outlet 32 so as to seal the container 31 and prevent a protruding wet tissue from drying up. Alternatively, instead of the hard container 31, a package (or envelope) of a liquid-impermeable film may be used to house the wet tissue stacked body 30. In addition, the wet tissue product of the invention can also be used as the so-called "refill package", in which the wet tissue stacked body 30 housed in the package is further housed in a hard container 31.

The first-group of folded wet tissues 11 and the second-group of folded wet tissues 21, as have been described in connection with the embodiment of the invention, arc all formed by folding the plane wet tissues of the same shape and size, as shown in FIGS. 1(A) and 2(A). However, the first-group of folded wet tissues 11 and the second-group of folded wet tissues 21 may be formed by folding plane wet tissues having different dimensions in the longitudinal direction (in the direction Y) from each other. Here, the locations of the individual folding lines are suitably adjusted to provide a preferable protrusion from the outlet 32. For example, the wet tissue stacked body can be prepared by forming the first-group of folded wet tissue using a plane wet tissue having a slightly smaller longitudinal dimension than that of a plane wet tissue for the second-group of folded wet tissue, and by stacking upper and lower wet tissues such that the area of the combined area between the upper and lower wet tissues may be about one fifth of the area of the plane wet tissue for the second-group folded wet tissue.

At the production process of the wet tissue stacked body 30, the first-group of folded wet tissues 11 and the second-group of folded of wet tissues 21 are formed by using guides and are combined. Generally, a three-folded wet tissue is likely to have a deviation in size at its folding step in the production. Therefore, in the wet tissue stacked body of the prior art shown in FIG. 8, for example, it is difficult to stack them in a secure manner because the stacked body is composed only of the three-folded wet tissues. On the other hand, in the wet tissue stacked body 30 of the invention, about half of the wet tissues are composed of the first-group of folded wet tissues 11. The first-group of folded wet tissue 11 can be accurate in size because its folding line 14 for folding a plane of wet tissue into two is identical to a centerline of the plane wet tissue.

Figure 8:
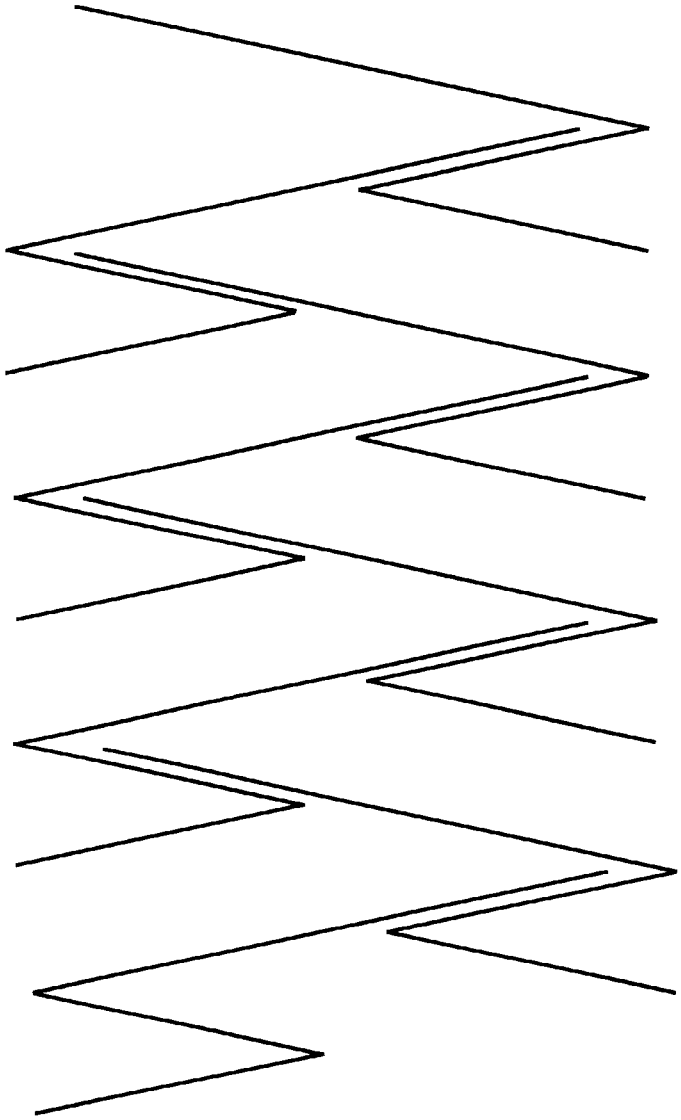
Fig. 8 PRIOR ART
FIG. 8 is a section showing another stacked body of wet tissues of the prior art.

Therefore, in the wet tissue stacked body 30 of the invention, the production method can be made simple and the stacked state of the wet tissues can be made uniform, as compared with the wet tissue stacked body of the prior art which is composed only of the three-folded wet tissues, as shown in FIG. 8. Further, when the stacked state of the wet tissues is uniform, the combined areas between the tissues can be made generally uniform, thereby making the degree of protrusion uniform.

However, in practice, there will be a more or less dispersion in size, even at the folding step of the production process of the wet tissue stacked body 30 of the invention. The combined areas between the wet tissues 11 and 21 do not have to be set accurately at one quarter of the area of the plane wet tissue, but may be less than or about one quarter of the area of the plane wet tissue.

Incidentally, the combined areas between the wet tissues 11 and 21 are preferably about one quarter of the area of the plane wet tissue, but may be about one fifth or one sixth thereof. Here, the combined areas are adjusted to such a degree that the protrusion of the wet tissue from the outlet can be pinched by fingers.

In the foregoing specification, the invention has been described in relation to preferred embodiments and many details have been set forth for the purpose of illustration. It will be apparent to those skilled in the art that the invention is susceptible to additional embodiments and that certain of the details described herein can be varied considerably without departing from the basic principles of the invention.

Further, 'comprises/comprising' when used in this specification is taken to specify the presence of stated features, integers, steps or components but does not preclude the presence or addition of one or more other features, integers, steps, components or groups thereof.

What is claimed is:

1. A wet tissue product comprising a stacked body of folded wet tissues, housed in one of a container and package, wherein the folded wet tissues comprise two groups selected from a first-group of folded wet tissues and a second-group of folded wet tissues, wherein each of the first-group of folded wet tissues is formed by folding a plane wet tissue in two generally along a centerline thereof, to form an upper half and a lower half, and each of the second-group of folded wet tissues is formed by folding another plane wet tissue with one edge thereof upward and with the other edge thereof downward, to form an upper folded portion, a lower folded portion and an intermediate portion, and the first-group of folded wet tissues and second-group of folded wet tissues are alternately stacked so that the upper half of the first-group of folded wet tissues is sandwiched between the lower folded portion and the intermediate portion of an overlying second-group of folded wet tissues, and the lower half of the first-group of folded wet tissues is sandwiched between the upper folded portion and the intermediate portion of an underlying second-group of folded wet tissues to form the stacked body, and the wet tissue exhibits a lower adhesion at one face and a higher adhesion at another face, to another wet tissue in a face-to-face contacting relationship, and wherein the first-group of folded wet tissues and second-group of folded wet tissues are combined such that the face of the lower adhesion and the other face of the higher adhesion confront each other at a combined area where half of the first-group of folded wet tissues and the folded portion of the second-group of folded wet tissues overlap.

2. The wet tissue product according to claim 1, wherein an area of the upper folded portion is equal to an area of the lower folded portion.

3. The wet tissue product according to claim 2, wherein an area of the upper and lower folded portions is about one quarter of an area of the plane wet tissue before folding.

4. The wet tissue product according to claim 3, wherein the plane wet tissue forming the first-group of folded wet tissues and the plane wet tissue forming the second-group of folded wet tissues have identical sizes and shapes.

5. The wet tissue product according to claim 1, wherein the container has an outlet which is positioned to confront a central facial portion of the folded wet tissues.

6. The wet tissue product according to claim 5, wherein a single wet tissue of the second-group of folded wet tissues is arranged at an uppermost position of the stacked body.

7. The wet tissue product according to claim 6, wherein a single wet tissue of the second-group of folded wet tissues is arranged at a lowermost position of the stacked body.

* * * * *